United States Patent [19]

Webinger

[11] 4,200,188

[45] Apr. 29, 1980

[54] PRODUCT DISPLAY CARTON

[75] Inventor: George Webinger, Minneapolis, Minn.

[73] Assignee: Champion International Corporation, Stamford, Conn.

[21] Appl. No.: 927,382

[22] Filed: Jul. 24, 1978

[51] Int. Cl.[2] ..... B65D 5/50

[52] U.S. Cl. ..... 206/45.14; 229/39 B; 229/16 D

[58] Field of Search ..... 206/45.14, 45.19, 45.31; 229/39 B, 16 D

[56] References Cited

U.S. PATENT DOCUMENTS

| | | | |
|---|---|---|---|
| 2,854,135 | 9/1958 | Pantalone | 206/45.14 X |
| 2,856,068 | 10/1958 | Paige | 206/45.14 |
| 3,000,546 | 9/1961 | Catri | 229/16 D |
| 3,869,077 | 3/1975 | Tuura | 229/16 D |
| 4,109,786 | 8/1978 | Roccaforte et al. | 206/45.14 |
| 4,128,168 | 12/1978 | Roccaforte | 206/45.14 |

*Primary Examiner*—George T. Hall

*Attorney, Agent, or Firm*—Evelyn M. Sommer

[57] ABSTRACT

A product display carton has four rectangular wall panels forming a rectangular tube. Retaining panels are connected to the wall panels only at the front edges of two opposing wall panels. The retaining panels, each of which has a product-receiving cutout, extend into the interior of the rectangular tube. The resiliency of the panel material causes the free edges of the retaining panels to be biased toward one another, causing an inserted product to be securely retained in the cutouts.

5 Claims, 5 Drawing Figures

PRODUCT DISPLAY CARTON

BACKGROUND OF THE INVENTION

The present invention relates to containers and more particularly to a low cost product display carton.

A number of products are marketed in display cartons or packages which reveal the actual product either to stimulate impulse buying of the product or to utilize information already appearing on the product itself for marketing purposes.

A number of different types of display cartons and packages have been developed. In the so called blister packages, the products are sealed to a paperboard backing by a layer of formed, transparent plastic material. In another type of display package, the products are sealed in a transparent plastic pouch, the upper end of which is closed by a paperboard panel upon which product and pricing information is normally printed or affixed.

Display packages of the types described above, require the use of relatively costly plastic machinery which naturally adds to the overall packaging costs. In addition, such packages cannot be readily stacked for display purposes but instead must be hung from hooks.

While products of this type could be packed in conventional rectangular boxes with lids for retaining the products, the cost of making and loading such boxes, even if made of a durable, relatively low cost material such as paperboard, are higher than a manufacturer might desire due to the amount of material required for a completely enclosed box and to the manufacturing costs associated with loading and closing that box.

SUMMARY OF THE INVENTION

The present invention is a low-cost paperboard display carton which uses a minimum amount of paperboard material and which can be readily loaded with a product to be displayed.

The carton includes first and second pairs of wall panels connected together to form a generally rectangular tube. A retaining panel is connected to one edge of each panel in one of the pairs of panels. Each retaining panel extends into the rectangular tube formed by the wall panels and includes a product-receiving cutout.

DESCRIPTION OF THE DRAWINGS

While the specification concludes with claims particularly pointing out and distinctly claiming that which is regarded as the present invention, further details of a preferred embodiment of the invention may be more readily ascertained from the following detailed description when read in conjunction with the accompanying drawings wherein:

DETAILED DESCRIPTION

Figure 1:
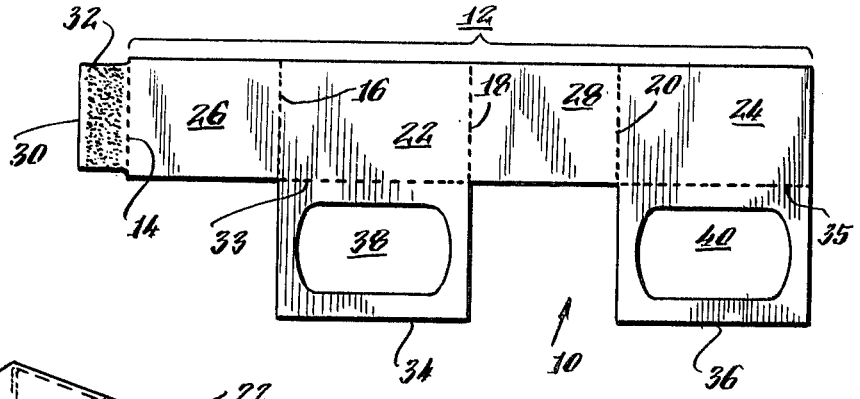
FIG. 1 is a plan view of a one piece blank from which a carton constructed in accordance with the present invention may be erected.

Referring to FIG. 1, a carton incorporating the present invention may be made from a blank 10 made of paper-board or any other suitable, foldable material. Wall panels for the blank 10 are formed from an elongated rectangular panel 12 which is subdivided by transverse fold lines 14, 16, 18 and 20 into a first pair of wall panels 22 and 24 and an alternating second pair of wall panels 26 and 28. For purposes of describing the invention, panels 22 and 24 are designated as the top wall and bottom wall panels, respectively, of the carton while panels 26 and 28 are designated as the left side wall and right side wall panels, respectively. It should be understood that these designations are arbitrary and are not to be construed as limiting the scope of the invention.

A relatively narrow glue flap 30 extends from the fold line 14 at the left edge of panel 26. The surface of glue flap 30 is largely covered with a coating 32 of a suitable pressure-sensitive or heat-sensitive adhesive.

The blank further includes first and second product-retaining panels 34 and 36 extending from corresponding edges of the top wall panel 22 and bottom wall panel 24. Each of the retaining panels is substantially as wide as the panel from which it extends. The length of each, in a transverse direction, is somewhat greater than the length of the panel from which it extends. Each of the retaining panels includes a product-receiving cutout or opening therethrough. More specifically, retaining panel 34 is shown with a generally oval opening 38 while panel 36 has an identical opening 40.

Figure 2:
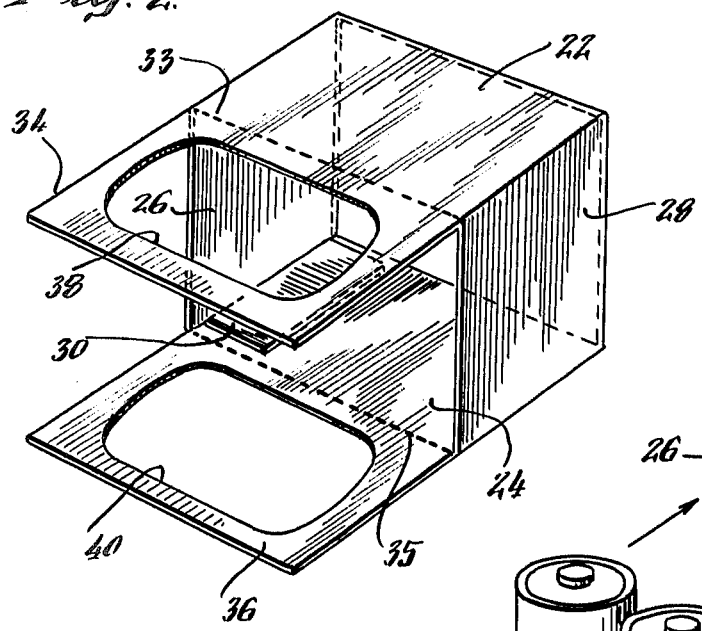
FIG. 2 is a perspective view showing a partially erected carton made from the blank of FIG. 1.

Referring to FIG. 2, a display carton is erected from the blank of FIG. 1 by forming the wall panels 22, 24, 26 and 28 into a rectangular tube with the adhesive-coated area 32 of glue flap 30 being brought into contact with the inner surface of the bottom wall panel 24. The retaining panels 34 and 36 are in the same plane as the panels from which they extend.

Figure 3:
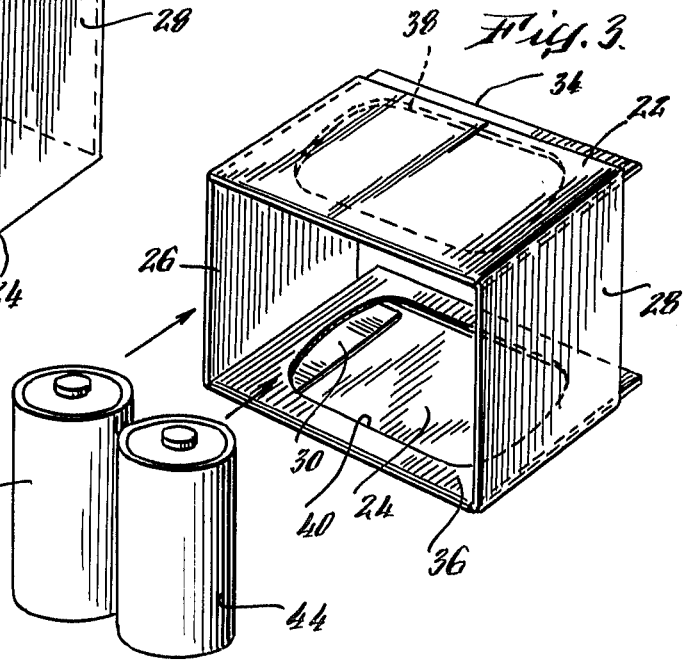
FIG. 3 is a perspective view of the erected carton ready to be loaded with a pair of storage batteries.

To ready the carton for loading, the panels 34 and 36 are rotated about fold lines 33 and 35, respectively, into the interior of the rectangular tube. Then, as shown at FIG. 3, the retaining panels 34 and 36 are held against the panels from which they extend while the products to be loaded are shoved into the rectangular tube, preferably through the open side having fold lines 33 and 35. Electric storage batteries 42 and 44 are an example of one type of product which may be carried in a display carton constructed in accordance with the present invention.

Figure 4:
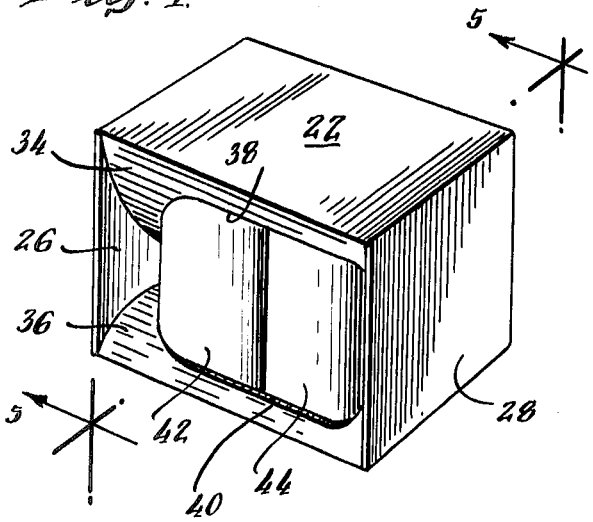
FIG. 4 is a perspective view of the erected carton after loading.
Figure 5:
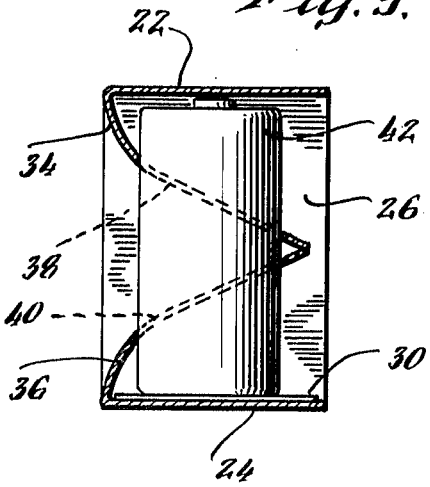
FIG. 5 is a cross sectional view taken along lines 5—5 of FIG. 4.

Referring to FIG. 4, when the batteries 42 and 44 are aligned with the cutouts 38 and 40 in the retaining panels, the retaining panels can be released. The natural resiliency of the sheet material allows the retaining panels 34 and 36 to spring together when released. This can be seen most clearly in FIG. 5. It will be noted that the storage batteries are securely retained by each of the retaining panels 34 and 36.

While there has been described what is considered to be a preferred embodiment of the invention, variations and modifications therein will occur to those skilled in the art once they become acquainted with the basic concepts of the invention. For example, while the drawings illustrate retaining panels with identical cutouts, it would be well within the ordinary skill in the art to provide differently-shaped cutouts for non-uniform products. Similarly, a plurality of cutouts could be provided in each retaining panel rather than a single cutout in order to hold products in spaced relationship to one another. Therefore, it is intended that the appended claims shall be construed to include all such variations and modifications as fall within the true spirit and scope of the invention.

What is claimed is:

1. A display carton made from a foldable sheet material for one or more products comprising:

a first pair of wall panels;

a second pair of wall panels connecting the panels in said first pair to form a generally rectangular tube;

a pair of retaining panels only to corresponding edges of the panels of said first pair of wall panels and extending into the interior of the rectangular tube, each of said retaining panels being generally rectangular and substantially the same length as and wider than the panel from which it extends, each retaining panel having at least one product-receiving, cutout formed therein.

2. A display carton as defined in claim 1 wherein the cutouts in the retaining panels are substantially identical.

3. A display carton as defined in claim 2 wherein the cutout in each retaining panel is a single cutout for receiving a plurality of products in side-by-side relationship.

4. A blank for a product display carton comprising:

an elongated rectangular panel divided into at least four shorter, generally rectangular wall panels by transverse fold lines;

a glue flap extending from one transverse edge of said elongated rectangular panel; and a pair of generally rectangular retaining panels connected to said wall panels only at corresponding edges of alternating ones of said wall panels, each of said retaining panels being substantially as long as and wider than the wall panel from which it extends, each of said retaining panels having at least one product receiving cutout therein, and wherein each of said panels is integrally connected to a single piece of sheet material.

5. A blank as defined in claim 4 wherein each of said retaining panels has a single cutout for receiving a plurality of products in side-by-side relationship.

* * * * *